252-95 AU 166 EX
9/25/79 XR 4,169,074

United States Patent [19]
Conrad et al.
[11] 4,169,074
[45] Sep. 25, 1979

[54] COMPOSITIONS FOR COLD WATER WASHING CONTAINING N-SUBSTITUTED ω-HYDROXYALKANE CARBOXYLIC ACID AMIDES

[75] Inventors: Jens Conrad, Hilden; Harald Schnegelberger; Hans Andree, both of Leichlingen; Guenter Jakobi, Hilden, all of Fed. Rep. of Germany

[73] Assignee: Henkel Kommanditgesellschaft auf Aktien (Henkel KGaA), Dusseldorf-Holthausen, Fed. Rep. of Germany

[21] Appl. No.: 889,990

[22] Filed: Mar. 24, 1978

[30] Foreign Application Priority Data

Apr. 2, 1977 [DE] Fed. Rep. of Germany ..... 2714832

[51] Int. Cl.[2] ..... C11D 3/26; C11D 7/32

[52] U.S. Cl. ..... 252/544; 252/95; 252/99; 252/117; 252/525; 252/529; 252/548; 8/137

[58] Field of Search ..... 252/548, 529, 525, 544, 252/117, 95, 99; 8/137

[56] References Cited

U.S. PATENT DOCUMENTS 2,383,740 8/1945 Tucker ..... 252/548
2,527,076 10/1950 Preston ..... 252/117
3,250,719 5/1966 Schmolka et al. ..... 252/548

*Primary Examiner*—Mayer Weinblatt
*Attorney, Agent, or Firm*—Hammond & Littell

[57] ABSTRACT

Cold-water active washing agent compositions comprising (a) from 0.3% to 2.5% by weight of an N-substituted-ω-hydroxyalkane carboxylic acid amide obtained by reacting substantially equimolar amounts of an N-($C_{8-20}$-alkyl)-di-amino-$C_{2-6}$-alkane with a lactone having 4 to 7 ring atoms, (b) a tenside mixture of anionic tensides of the sulfonate and/or sulfate type and/or zwitterionic tensides, optionally together with soaps and/or nonionic tensides, in an amount sufficient to give a weight ratio of (a) to (b) of from 1:50 to 1:2, preferably 1:20 to 1:2, and (c) a powdery or liquid carrier selected from the group of powdery organic and inorganic builders, of water-soluble lower alkanols, alkanediols, alkoxyalkanols, and alkoxyalkoxyalkanols, and of water, said component (c) being present in an amount of from 50% to 99.1% by weight and, in the case of powdery carriers, also may include a powdery bleaching component.

10 Claims, No Drawings

COMPOSITIONS FOR COLD WATER WASHING CONTAINING N-SUBSTITUTED ω-HYDROXYALKANE CARBOXYLIC ACID AMIDES

BACKGROUND OF THE INVENTION

The customary requirements for the obtaining of satisfactory washing results call for the use of warm washing liquors. The availability of hot water from hot-water appliances or by heater equipped washing machines, therefore, is not only a prerequisite for a successful wash but also a significant laundry cost factor. Though recent developments have shown that because of changed consumer habits and the emergence of easy-care textiles made of synthetic fiber, the previously practiced wash at the boil temperature has been gradually replaced by the so-called 60° C. wash, i.e., washing at a water temperature of 60° C. or 140° F. This also gives rise to a considerable energy savings. However, to save more thermal energy on washing and to successfully wash also in cases where only cold water is available, it is necessary to develop a detergent for cold wash, which produces good wash results also with non-heated water, that is, with water at temperatures of 10° to 30° C., specifically 15° to 25° C., as obtained generally from tap water sources.

OBJECTS OF THE INVENTION

An object of the invention is the development of a detergent specifically suitable also for cold-water washed textiles, which contains a combination of specified tensides with an amide of a ω-hydroxyalkane carboxylic acid.

Another object of the present invention is the development of a cold-water-active washing agent composition consisting essentially of (a) from 0.3% to 2.5% by weight of an N-substituted-ω-hydroxyalkane carboxylic acid amide obtained by reacting substantially equimolar amounts of an N-($C_{8-20}$-alkyl)-diamino-$C_{2-6}$-alkane with a lactone having the formula

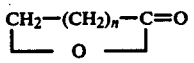

wherein n is an integer from 1 to 4, (b) a tenside mixture of surface-active compounds selected from the group consisting of anionic tensides of the sulfonate type, anionic tensides of the sulfate type, zwitterionic tensides and mixtures thereof, optionally together with further surface-active compounds selected from the group consisting of soaps, nonionic tensides and mixtures thereof, in an amount sufficient to give a weight ratio of (a) to (b) of from 1:50 to 1:2, (c) a powdery or liquid carrier material selected from the group consisting of (1) powdery carriers selected from the group consisting of organic builders, inorganic builders and mixtures thereof, optionally including bleaching agent components, and (2) liquid carriers selected from the group consisting of water-soluble alkanols, water-soluble alkanediols, water-soluble alkoxyalkanediols, water-soluble alkoxyalkanols, water-soluble alkoxyalkoxyalkanols and water, said component (c) being present in an amount of from 50% to 99.1% by weight of said washing agent composition, and (d) from 0.5% to 10% by weight of at least one conventional component of the type: foam inhibitors, optical brighteners, soil suspension agents, enzymes, antimicrobials, dyes and perfumes.

A further object of the present invention is the development of a method of washing laundry at temperatures of between 10° C. and 30° C. employing 1.0 gm/l to 12.0 gm/l of the above cold-water active detergent.

These and other objects of the present invention will become more apparent as the description thereof proceeds.

DESCRIPTION OF THE INVENTION

The above objects have been achieved and the drawbacks of the prior art have been overcome by the development of a cold-water-active washing agent composition or detergent characterized in that it substantially consists of (a) 0.3% to 2.5% by weight of N-substituted-ω-hydroxyalkane carboxylic acid amide which is obtained by reacting substantially equimolar amounts of an N-($C_{8-20}$-alkyl)-diamino-$C_{2-6}$-alkane with a lactone having 4 to 7 ring atoms, (b) a tenside mixture of anionic tensides of a sulfonate and/or sulfate type and/or zwitterionic tensides, optionally together with soaps and/or nonionic tensides, in an amount of said mixture, which is sufficient to establish a weight ratio of ω-hydroxyalkane carboxylic acid amide according to (a) to the tenside mixture (b) of 1:50 to 1:2, preferably 1:20 to 1:2, and (c) a powdery and/or liquid carrier material selected from the group of powdery organic and inorganic builders, of water-soluble low molecular weight alcohols, diols and ether alcohols, and of water, which is present in an amount to constitute 50% to 99.1% by weight, specifically 55% to 90% by weight of the detergent and which, with powdered detergent types, optionally include also a powdery bleaching component.

More particularly, the present invention relates to a cold-water-active washing agent composition consisting essentially of (a) from 0.3% to 2.5% by weight of an N-substituted-ω-hydroxyalkane carboxylic acid amide obtained by reacting substantially equimolar amounts of an N-($C_{8-20}$-alkyl)-diamino-$C_{2-6}$-alkane with a lactone having the formula

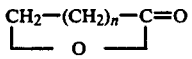

wherein n is an integer from 1 to 4, (b) a tenside mixture of surface-active compounds selected from the group consisting of anionic tensides of the sulfonate type, anionic tensides of the sulfate type, zwitterionic tensides and mixtures thereof, optionally together with further surface-active compounds selected from the group consisting of soaps, nonionic tensides and mixtures thereof, in an amount sufficient to give a weight ratio of (a) to (b) of from 1:50 to 1:2, (c) a powdery or liquid carrier material selected from the group consisting of (1) powdery carriers selected from the group consisting of organic builders, inorganic builders and mixtures thereof, optionally including bleaching agent components, and (2) liquid carriers selected from the group consisting of water-soluble alkanols, water-soluble alkanediols, water-soluble alkoxyalkanediols, water-soluble alkoxyalkanols, water-soluble alkoxyalkoxyalkanols and water, said component (c) being present in an amount of from 50% to 99.1% by weight of said washing agent composition, and (d) from 0.5% to 10% by weight of at least one conventional component of the type: foam inhibitors, optical brighteners, soil suspension agents, enzymes, antimicrobials, dyes and perfumes.

Hereinafter, the N-substituted-ω-hydroxyalkane carboxylic acid amide used in the compositions of the invention, will also be designated as "carboxamide".

The discovery made is that even above given minor amount of "carboxamide" with the tenside or tenside mixture produces a synergistic rise in washing power specifically in a cold washing liquor.

Detergents according to the invention contain other preferably conventional detergent components from the group of foam inhibitors, optical brighteners, soil suspension agents, enzymes, antimicrobials, dyes, and perfumes, adding up to amounts of from 0.5% to 10% by weight.

Detergents according to the invention are prepared as powdery, pasty or liquid preparations. In the case of powdery detergents the carrier materials consist of powdery organic and inorganic builders which can be of a water-soluble or water-insoluble type and which, at least partially, consist of such substances that have a complexing (sequestering) and/or precipitating effect on the constituents causing water hardness. The powdery carrier materials and/or builders optionally also include active-oxygen-yielding bleaching components.

Together with and/or instead of water, the liquid embodiments of detergents according to the invention can contain low-molecular weight, water-miscible organic solvents, specifically from the group of aliphatic, 1 to 6 carbon atom content alcohols, diols and ether alcohols, as liquid carriers. More particularly, these are alkanols, alkanediols, alkoxyalkane diols, alkoxyalkanols and alkoxyalkoxyalkanols.

The detergent according to the invention makes it feasible to successfully carry out the customary washing operations by hand and washing machine with cold water directly from tap water sources. As far as the detergents according to the invention also contain a bleaching component from peroxy compounds acting as oxygen carrier, specifically sodiu-perborate, stabilizers and in any given case activators, an additional bleaching effect is produced on washing at elevated temperatures, i.e., with a 60° C. wash or washing at the boiling temperature (98° C.). Also on washing at these elevated temperatures in the washing machine the "carboxamides" used according to the invention profitably contribute to the total washing effect. On this basis the composition of the detergent according to the invention can be varied according to the use of application. Universally usable (all-temperature) detergents, which can be applied to both cold washing and washing at the boiling temperature, therefore, advantageously contain said bleaching component, which can constitute from 10% to 40%, specifically 15% to 35% by weight of the entire detergent.

Detergents according to the invention, which display an extremely high cleansing power effect at both cold and elevated temperatures and/or boiling wash temperature, contain as tenside component (b) a sulfonate and/or sulfate tenside together with a nonionic tenside, specifically of the ethoxylated aliphatic $C_{10-20}$-alcohol type. Such tenside mixtures (b) are composed of 1 part by weight of a sulfonate and/or sulfate tenside and 0.2 to 5 parts by weight of a nonionic tenside, especially of the ethoxylated, aliphatic $C_{10-20}$ alcohol type, where the alcohol is an alkanol, an alkenol, or mixtures thereof. Generally, such tenside mixtures (b) constitute 5% to 50% by weight, especially 5% to 25% by weight of the total composition. With tenside mixtures such as these a particularly high washing effect is observed if the above nonionic ethoxylation products are present as mixture of products having a differential average ethoxylation grade and if in this mixture the ratio of addition products of 8 to 10 mols of ethylene oxide per mol of aliphatic $C_{10-20}$ alcohol to ethoxylation products with 2 to 7 mols of ethylene oxide per mol of alcohol amounts to 5:1 to 1:3.

Detergents of a low tendency to foam according to the invention contain 0.2% to 0.8% by weight of a non-surface-active foam inhibitor or 0.5% to 5% by weight of an alkali metal soap substantially from $C_{18-22}$ fatty acids, or a mixture from said non-surface-active foam inhibitors and said soap in the amount of 0.2% to 5% by weight.

The manufacture of pourable powdery preparations can be effected by conventional methods, e.g., by simply mixing the powder components or through the cold and hot spray-drying of aqueous suspensions of the ingredients. The "Carboxamide" can also be sprayed in a molten or dissolved state onto the powdered particles of the other components of the preparation or on a part of the builders in the customary manner. In this case sodium tripolyphosphate and sodium sulfate types with bulk weights of 200 to 500 gm/l are particularly suitable as carriers.

Liquid to pasty preparations preferably are so manufactured that the tenside mixture is dissolved in the liquid carrier, then the "carboxamide" is added, and the mixture is homogenized by stirring and, optionally, by heating, and thereafter, any further provided components are mixed in.

The ω-hydroxyalkane carboxylic acid amides with N-$C_{8-20}$-alkyl-diamino-$C_{2-6}$-alkanes are known compounds. Typical "carboxamides" are obtained by reacting at least one diamine of the formula $$R—NH—(CH_2)_m—NH_2$$

where R is an alkyl having 8 to 20 carbon atoms and m is an integer from 2 to 6 with a lactone of the formula $$\underbrace{CH_2—(CH_2)_n—C}_{O}=O$$

where n is an integer from 1 to 4. Representative diamines are as follows:

N-octyl-diaminoethane
N-octyl-diaminopropane
N-octyl-diaminohexane
N-decyl-diaminoethane
N-decyl-diaminopropane
N-decyl-diaminohexane
N-dodecyl-diaminoethane
N-dodecyl-diaminopropane
N-dodecyl-diaminohexane
N-tetradecyl-diaminoethane
N-tetradecyl-diaminopropane N-tetradecyl-diaminohexane
N-coco-fatty alkyl-diaminoethane
N-coco-fatty alkyl-diaminopropane
N-coco-fatty alkyl-diaminohexane
N-tallow-fatty alkyl-diaminoethane
N-tallow-fatty alkyl-diaminopropane
N-tallow-fatty alkyl-diaminohexane The lactones are respectively β-propiolactone, γ-butyrolactone, δ-valerolactone and ε-caprolactone. Of especial significance because of their good accessibility are the addition products, the N-($C_{8-20}$-alkyl)-diaminopropanes, specifically to those with $C_{10-18}$-alkyl groups.

The invention further relates to a process for washing textiles by using detergents according to the invention. This process is characterized in that textiles in an aqueous washing liquor are agitated, either manually or mechanically, for 10 to 60 minutes at a temperature of between 10° C. and 30° C., especially 15° C. and 25° C., where said washing liquor contains the above defined detergent in amounts of 1.0 gm/l to 12.0 gm/1, preferably 4.0 gm/l to 10.0 gm/l, and that subsequently the textiles are separated from the washing liquor and are rinsed with fresh water till the complete removal of washing liquor components and dried.

If the washing liquor contains a peroxy compound as bleach, then subsequently to the washing process in said cold washing liquor, a desired bleaching effect on the textiles can be produced by heating said washing liquor from 5 to 20 minutes to temperatures of preferably 60° C. to 95° C.

The following is a detailed description of the key components contained in the detergents according to the invention, which are listed according to the classes of substances.

The tensiles contain in the molecule at least one hydrophobic organic radical and a water solubilizing or hydrophilic anionic, zwitterionic or nonionic group. In most cases the hydrophobic radical is an aliphatic hydrocarbon radical with 8 to 26, preferably 10 to 22, and specifically 12 to 18 carbon atoms, or an alkylaromatic radical, specially an alkylphenyl, with 6 to 18, preferably 8 to 16 aliphatic carbon atoms.

Usable anionic surface-active compounds or tensides include alkali metal soaps made from natural or synthetic, preferably saturated fatty acids, and optionally from resinic or naphthenic acids. Suitable synthetic anionic tensides are typified by sulfonates, sulfates and synthetic carboxylates.

Applicable sulfonate type tensides include alkylbenzene sulfonates containing from 9 to 15 carbon atoms in the alkyl, olefin sulfonates, that is, mixtures of alkenesulfonates and hydroxyalkane sulfonates and alkane disulfonates, as are obtained from $C_{12-18}$-mono-olefins with terminal or non-terminal double bonds by sulfonating with gaseous sulfur trioxide and a subsequent alkaline or acidic hydrolysis of the sulfonation products. Suitable, too, are alkane sulfonates, which are obtained from $C_{12-18}$-alkanes by sulfochlorination or sulfoxidation and subsequent hydrolysis and/or neutralization, and/or obtained by bisulfite addition to olefins, as well as esters of α-sulfofatty acids, such as, the α-sulfonated methyl or ethyl esters of hydrogenated coco-fatty acids, hydrogenated palm kernel fatty acids or hydrogenated tallow fatty acids.

Suitable sulfate type tensides include the sulfuric acid monoesters of primary alcohols, such as alkanols and alkenols having 8 to 26 carbon atoms, such as coco-fatty alcohols, tallow fatty alcohols or oleyl alcohol, and those of secondary alkanols. Suitable, too, are sulfated fatty acid alkanolamides, sulfated fatty acid monoglycerides or sulfated reaction products of 1 to 4 mols of ethylene oxide with primary or secondary fatty alcohols or alkyl phenols.

Other suitable anionic tensides are fatty acid esters and/or amides of hydroxy carboxylic acids, amino carboxylic acids, hydroxysulfonic acids and aminosulfonic acids such as fatty acid sarcosides, fatty acid glycolates, fatty acid lactates, fatty acid taurides or fatty acid isethionates.

Anionic tensides can be present in the form of their alkali-metal salts such as sodium or potassium, their ammonium salts and their water-soluble salts with organic bases such as monoethanolamine, diethanolamine, or triethanolamine.

Usable nonionic tensides include the addition products of 1 to 40, preferably 2 to 20 mols of ethylene oxide, adducted onto 1 mol of an aliphatic compound having a labile hydrogen atom with substantially 10 to 20 carbon atoms selected from the group of alcohols, alkane carboxylic acids, fatty amines, carboxylic-acid amides or alkane sulfonamides. Alkylphenols having 6 to 18 carbon atoms in the alkyl may also be adducted with the ethylene oxide. Key addition products are those of 8 to 20 mols of ethylene oxide added to primary alcohols, such as to coco-fatty alcohol or tallow fatty alcohol, to oleyl alcohol, to oxo-alcohols, or to secondary alkanols, all with 8 to 18, preferably 12 to 14 carbon atoms in the alkyl radicals. But aside from water-soluble nonionics, also water-insoluble and/or not completely water-soluble polyglycolethers with 2 to 7 ethylene glycolether molecules per aliphatic compound having a labile hydrogen atom, can be employed, particularly if they are used together with water-soluble nonionic or anionic tensides.

Also usable nonionic tensides include the water-soluble addition products containing 20 to 250 ethylene glycol ether groups and 10 to 100 propylene glycol ether groups from ethylene oxide adducted onto polypropylene glycol or alkylene diamine polypropylene glycol or alkylpolypropylene glycol with 1 to 10 carbon atoms in the alkyl chain, wherein the polypropylene glycol chain acts as the hydrophobic radical. Also nonionic tensides of the amineoxide or sulfoxide type are usable, e.g., the N-coco-fatty alkyl-N, N-dimethylamineoxide, N-hexadecyl-N, N-bis-(2,3-dihydroxypropyl)-amineoxide, N-tallow fatty alkyl-N, N-(dihydroxyethyl)-amineoxide.

The expression "nonionic tensides (nonionics)", accordingly, does not embrace the N-substituted-ω-hydroxyalkane carboxamides used according to the invention.

The zwitterionic tensides are preferably derivates of aliphatic quaternary ammonium compounds, in which one of the aliphatic radicals consists of a $C_{8-18}$-radical and another contains an anionic, water-solubilizing carboxy, sulfo or sulfato group. These compounds are carbobetaines, sulfobetaines and sulfatobetaines. Typical representatives of surface-activw betaines are exemplified by 3-(N-hexadecyl-N, N-dimethylammonio)-propane sulfonate, 3-(N-tallow fatty alkyl-N, N-dimethylammonio)-2-hydroxypropane sulfonate, 3-[N-hexadecyl-N, N-bis (2-hydroxyethyl)-ammonio]-2-hydroxy-propylsulfate, 3-[N-coco-fatty alkyl-N, N-bis(2,3-dihydroxypropyl)-ammonio]-propane sulfonate, N-tetradecyl-N, N-dimethylammonioacetate, N-hexadecyl-N,N-bis(2,3-dihydroxypropyl)-ammonioacetate, etc.

The foaming tendency of aqueous solutions of the tensides can be raised or reduced by combining suitable tenside types. A reduction can also be obtained by adding non-surface-active foam inhibitors. In many cases a reduced foaming tendency, as desired in machine operations, is attained by combining various tenside types, e.g., of sulfates and/or sulfonates with nonionics and/or soaps. The foam inhibiting effect of soaps increases with the degree of saturation and the number of carbon atoms of the fatty acid radical. Suitable foam inhibiting soaps, therefore, are soaps of natural and synthetic origin, which have a high percentage of $C_{18-22}$ fatty acids, such as derivates of hydrogenated train oil and hydrogenated rape oil. Customarily in most cases fatty acid mixtures with a chain length distribution of from $C_{12}$ to $C_{22}$ are employed. In this context, the term "fatty acid soaps with substantially $C_{18-22}$ carbon atoms" refers to those soaps which consist of at least 50% by weight of $C_{18-22}$ fatty acid salts. The combination of foam inhibiting soaps with non-surface-active foam inhibitors primarily is suitable for foam control in washing machines during the actual washing stage as well as during the rinsing out of the washing liquor.

Generally, non-surface-active foam inhibitors are water-insoluble compounds containing mostly aliphatic $C_{8-22}$ carbon atom radicals. Suitable non-surface-active foam inhibitors are: N-alkylamino-triazines, that is, reaction products of 1 mol of cyanuric chloride with 2 to 3 mols of a mono- or dialkyl amine with substantially 8 to 18 carbon atoms in the alkyl radicals. Suitable, too, are propoxylated and/or butoxylated aminotriazines, for example, reaction products of 1 mol melamine with 5 to 10 mols of propylene oxide and additional 10 to 50 mols of butylene oxide, as well as aliphatic $C_{18-40}$ -ketones, particularly $C_{18-40}$ alkanones, such as stearone, the fatty ketones from hydrogenated train oil fatty acid or tallow-fatty acid, etc. and, further, the paraffins and haloparaffins having melting points below 100° C., also silicone oil emulsions based on polymeric silicon-organic compounds.

Suitable as organic and inorganic builders are the slightly acid, neutral or alkaline reacting salts, specifically the alkali metal salts, of compounds which are capable of precipitating or complexing calcium ions. Aside from tetra-hydrofurane-tetracarboxylic alkali metal orthophosphates and alkali metal pyrophosphates, of special importance among the inorganic salts are the water-soluble alkali metal metaphosphates or alkali metal polyphosphates, especially pentasodium tripolyphosphate. These phosphates can be replaced completely or partially by organic complexers for calcium ions. Included here are compounds of the amino-polycarboxylic acid type, such as nitrilotriacetic acid, ethylenediaminetetraacetic acid, diethylenetriamine-pentaacetic acid, and higher homologues. Suitable phosphorus-containing organic complexers include the water-soluble salts of alkane polyphosphonic acids, aminoalkane polyphosphonic acids and hydroxyalkane polyphosphonic acids and phosphonopolycarboxylic acids, such as methane-diphosphonic acid, diemthylaminomethane-1, 1-diphosphonic acid, aminotri-(methylenephosphonic acid), 1-hydroxyethane-1, 1-diphosphonic acid, 1-phosphono-ethane-1, 2-dicarboxylic acid, 2-phosphono-butane-1,2,4-tricarboxylic acid, etc.

Important organic builders are the N-/and P-free polycarboxylic acids forming complex salts with calcium ions, which also include polymerizates containing carboxyl groups. These include, for example, citric acid, tartaric acid, benzene hexacarboxylic acid and tetra-hydrofurane-tetracarboxuylic acid. Also polycarboxylic acids containing ether groups can be used, such as 2,2'-oxydisuccinic acid, as well as multi-hydric alcohols or hydroxycarboxylic acids partially or completely etherified with glycolic acid, such as biscarboxymethylethylene glycol, carboxymethoxy-succinic acid, carboxymethyltartronic acid, and carboxy-methylated and/or oxidized polysaccharides. Suitable, too, are the polymeric carboxylic acids having molecular weights of at least 350 in the form of their water-soluble salts, such as polyacrylic acid, poly-α-hydroxyacrylic acid, polymaleic acid, and the copolymers of corresponding monomeric carboxylic acids with each other or together with ethylenically-unsaturated compounds such as ethylene, propylene, isobutylene, vinylmethylether or furane.

Suitable water-insoluble, inorganic builders include the finely divided, synthetically manufactured, water-insoluble silicates containing bound water and have a calcium binding power of from 50 to 200 mg CaO/gm based on the anhydrous active substance, of the general formula $$0.7\text{–}1.5Cat_{2/n}O.Me_2O.0.8\text{–}6SiO_2,$$

wherein Cat designates a cation having the valence n which is interchangeable with the calcium ion, and Me designates aluminum or boron. These compounds have been more closely described in DOS No. 2,412,837 as well as Ser. No. 458,306, filed Apr. 5, 1974, now abandoned, and its continuation Ser. No. 800,308, filed May 25, 1977, now abandoned in favor of its continuation-in-part Ser. No. 956,851, filed Nov. 5, 1978, for use as phosphate substitutes for detergents and cleansers. Preferably used are the alkali metal aluminosilicates of this composition, specifically the crystalline sodium aluminosilicates of the composition $$0.7\text{–}1.1Na_2O.Al_2O_3.1.3\text{–}3.3SiO_2,$$

the calcium binding power of which is in the 100 to 200 mg/gm range, based on the anhydrous aluminosilicate, where the particle sizes of these aluminosilicates generally are below 50μ, preferably below 40μ and mostly in the range of 0.1 to 20μ.

Suitable inorganic, non-complexing builders are the alkali-metal bicarbonates, carbonates, borates, sulfates or silicates, which are designated also as "wash alkalis". From among the alkali metal silicates, primarily sodium silicates with a $Na_2O:SiO_2$ ratio of 1:1 to 1:3.5 are preferable.

Further builders, which because of their hydrotropic properties can be used mostly in liquid agents, are the salts of non-surface-active, sulfonic acids, carboxylic acids and sulfocarboxylic acids, containing from 2 to 9 carbon atoms, for example, the alkali metal salts of $C_{2-9}$-alkanesulfonic acids, benzene sulfonic acid, toluene sulfonic acid, xylene sulfonic acid or cumene sulfonic acid, or sulfobenzoic acids, of sulfophthalic acids, of sulfoacetic acid, of sulfo-succinic acid, and the alkali metal salts of acetic or lactic acid. Usable dissolving intermediaries also include acetamide and urea.

The washing agent compositions of the invention can also contain soil suspension agents, which keep the dirt, detached from the fibers, suspended in the liquor and thus prevent graying effects. For this purpose water-soluble colloids of mostly an organic nature are suitable, such as the water-soluble salts of polymeric carboxylic acids, glue, gelatine, salts of ethercarboxylic acids-substituted or ethersulfonic acid-substituted, starch or cellulose or salts of acid sulfuric acid esters of cellulose or starch. Also polyamides containing water-soluble, acidic groups are suitable for this purpose. Furthermore, soluble starch preparations and starch products other than those listed above can be used, such as degraded starch, aldehyde starches, etc. Also polyvinyl pyrollidone is usable as a soil suspension agent. The sodium salt of carboxymethyl cellulose is preferred.

Among the compounds serving as bleaching agents, which yield $H_2O_2$ in water, sodium perborate-tetrahydrate ($NaBO_2.H_2O_2.3H_2O$) and sodium perborate-monohydrate ($NaBO_2.H_2O_2$) are of key importance. However, other borates yielding $H_2O_2$ in solutions are usable, such as perborax $Na_2B_4O_7.4H_2O_2$. These compounds can be partially or completely replaced by other active oxygen carriers, especially the peroxyhydrates, such as peroxycarbonates ($Na_2CO_3.1.5\ H_2O_2$), peroxypyrophosphates, citrateperhydrates, urea-$H_2O_2$ orr melamine-$H_2O_2$ compounds, as well as by $H_2O_2$-yielding peracid salts, such as caroate ($KHSO_5$), perbenzoate or peroxyphthalate.

It is recommended that conventional water-soluble and/or water-insoluble stabilizers for the percompounds are employed together with the percompounds in amounts of 0.25% to 10% by weight. Suitable water-insoluble stabilizers, which can constitute 1% to 8%, preferably 2% to 7% by weight of the total preparation, include magnesium silicates of the ratio $MgO:SiO_2=4:1$ to 1:4, preferably 2:1 to 1:2, and specifically 1:1, obtained mostly by precipitation from aqueous solutions. In their place other alkaline earth metal silicates or tin silicates of corresponding composition are usable. Hydrous stannic oxides are also suitable as stabilizers. the water-soluble stabilizers, which can be present alone or together with the water-insoluble ones are organic sequestering agents for heavy-metal ions, and can be present in an amount of 0.25% to 5%, preferably 0.5% to 2.5% by weight of the total preparation.

Activators for percompounds, which yield $H_2O_2$ in water, include N-acyl and/or O-acyl compounds, specifically acetyl-, propionyl- or benzoyl compounds, forming organic pre-acids with said $H_2O_2$, as well as carbonic acid-and/or pyrocarbonic acid esters. Among other usable compounds are: N-diacylated and N,N'-tetraacylated amines such as N,N,N',N'-tetraacetylmethylene diamine and/or ethylene-diamine, N,N-diacetylaniline and N,N-diacetyl-p-toluidine and/or 1,3-diacylated hydantoins, alkyl-N-sulfonyl-carbonamides, for example, N-methyl-N-mesyl-acetamide, N-methyl-N-mesyl-benzamide, N-methyl-N-mesyl-p-nitrobenzamide, and N-methyl-N-mesyl-p-methoxybenzamide, N-acylated cyclic hydrazides, acylated triazoles or urazoles such as monoacetylmaleic acid hydrazide, O,N,N-trisubstituted hydroxylamines such as O-benzoyl-N, N-succinyl-hydroxylamine, O-acetyl-N,N-succinyl-hydroxylamine, O-p-methoxybenzoyl-N,N-succinyl-hydroxylamine, O-p-nitrobenzoyl-N,N-succinylhydroxylamine and O,N,N-triacetyl-hydroxylamine, N,N'-diacylsulfurylamides, such as N,N'-dimethyl-N,N'-diacetyl-sulfurylamide, and N,N'-diethyl-N,N'-dipropionyl-sulfurylamide, triacylcyanurates, such as triacetyl or tribenzoylcyanurate, carboxylic acid anhydrides such as benzoic acid anhydride, m-chlorobenzoic acid anhydride, phthalic acid anhydride, 4-chlorophthalic acid anhydride, sugar esters such as glucose penta-acetate, 1,3-diacyl-4,5-diacyloxyimidazolidines, for example, the compounds 1,3-diformyl-4,5-diacetoxyimidazolidine, 1,3-diacetyl-4,5-diacetoxyimidazolidine, 1,3-diacetyl-4,5-dipropionyloxy-imidazolidine, acylated glycolurils such as tetrapropionylglycoluril or diacetyldibenzoyl-glycoluril, diacylated 2,5-diketopiperazines, such as 1,4-diacetyl-2,5-diketopiperazine, 1,4-dipropionyl-2,5-diketopiperazine, 1,4-dipropionyl-3, 6-dimethyl-2,5-diketopiperazine, acetylated and/or benzoylated products of propylene-di-urea and/or 2,2-dimethylpropylene-di-urea (2,4,6,8-tetra-aza-bicyclo-(3,3,1)-nonane-3,7 -dione and/or its dimethyl derivate), sodium salts of p-(ethoxycarbonyloxy)-benzoic acid and p-(propoxycarbonyloxy)-benzenesulfonic acid.

The optical brighteners for cotton, which can be present in the detergents of the invention, can be derivates of diaminostilbenedisulfonic acids and/or their alkali metal salts. Suitable, for example, are salts of 4,4'-bis-(2-anilino-4-morpholino-1,3,5-triazine-6-yl-amino)-stilbene-2,2'-disulfonic acid or compounds of the same structure which, instead of the morpholino group, have a diethanolamino group, a methylamino group or a 2-methoxyethylamino group. Optical brighteners for polyamide fibers are, for example, of the type of the 1,3-diaryl-2-pyrazolines, for example, the compound 1-(p-sulfamoylphenyl)-3-(p-chlorophenyl)-2-pyrazoline as well as compounds of the same structure, which instead of the sulfamoyl group, have a methoxycarbonyl group, a 2-methoxy-ethoxycarbonyl group, an acetylamino group or a vinylsulfonyl group. Further usable polyamide optical brighteners are the substituted aminocoumarins, for example, 4-methyl-7-dimethylaminocoumarin or 4-methyl-7-diethylaminocoumarin. Further usable polyamide optical brighteners are 1-(2-benzimidazolyl)-2-(1-hydroxyethyl-2-benzimidazolyl)-ethylene and 1-ethyl-3-phenyl-7-diethylamino-carbostyril. Suitable optical brighteners for polyester and polyamide fibers are 2,5-di-(2-benzoxazolyl)-thiopene, 2-(2-benzoxazolyl)-naphtho[2,3-b]-thiopene, and 1,2-di-(5-methyl-2-benzoxazolyl)-ethylene. Furthermore, optical brighteners of the substituted 4,4'-distyryl-diphenyl type can be present, such as 4,4'-bis-(4-chloro-3-sulfostyryl)-diphenyl. Also mixtures of above optical brighteners can be used.

Suitable water-soluble organic solvents which can be employed are primarily lower alcohols, ether alcohols and glycols with 1 to 6 carbon atoms, that is, alkanols having 1 to 6 carbon atoms, alkanediols having 2 to 6 carbon atoms, alkoxyalkanediols having 4 to 6 carbon atoms, alkoxyalkanols having 3 to 6 carbon atoms and alkoxyalkoxyalkanols having 5 to 6 carbon atoms, such as methanol, ethanol, propanol, isopropyl alcohol, ethylene glycol, propylene glycol, diethylene glycol, methyl ethylene glycol, ethyl ethylene glycol, butyl ethylene glycol, etc.

The following specific embodiments are illustrative of the practice of the invention without being limitative in any manner.

EXAMPLES

N-substituted $\omega$-hydroxyalkane carboxamides can be manufactured according to the following general operating procedure.

A mixture of 1 mol of amine and 1.2 mols of lactone are heated for 2 hours to 120° C. and cooled. The solidified product is recrystallized from ethanol or acetone.

In accordance with this procedure, the following compounds were produced:

1. The δ-hydroxyvaleramide of N-decyl-diaminopropane; melting point 78°–80° C.;
2. the δ-hydroxyvaleramide of N-dodecyl-diaminopropane; melting point 79°–81° C.;
3. the γ-hydroxybutyramide of N-decyl-diaminopropane; melting point 53–56° C.;
4. the γ-hydroxybutyramide of N-dodecyl-diaminopropane; melting point 57°–61° C.;
5. the ε-hydroxycapronamide of N-octyl-diaminopropane; melting point 65°–70° C.;
6. the γ-hydroxybutyramide of N-coco-alkyl-diaminopropane;
7. the β-hydroxypropionamide of N-tallow-alkyl-diaminopropane.

The following examples describe the composition and effect of some detergents according to the invention and the implementation of a washing process according to the invention. The additives used were the above ω-hydroxyalkane carboxamides.

EXAMPLE 1

This example describes the composition of a foam inhibiting cold water detergent, which is particularly suitable for washing machines.

6.0% by weight of sodium dodecylbenzene sulfonate;
1.0% by weight of the adduct from 1 mol of tallow fatty alcohol and 14 mols of ethylene oxide;
1.0% by weight of the adduct from 1 mol of oleyl/-cetyl alcohol and 5 mols of ethylene oxide;
1.0% by weight of N-substituted ω-hydroxyalkane carboxamide;
3.0% by weight of soap (Na-salt of substantially $C_{18-22}$-fatty acids);
60.0% by weight of sodium tripolyphosphate;
2.0% by weight of water glass ($Na_2O+3.35SiO_2$);
0.2% by weight of sodium ethylenediaminetetraacetate;
1.2% by weight of carboxymethylcellulose, sodium salt;
Remainder sodium sulfate and water.

To verify the cold washing ability of the detergent, laundrometric tests were carried out with the "carboxyamides" under the following conditions:

Wash temperature: 20° C.; water hardness: 16° dH; detergent concentration: 6.0 gm/l; washing liquor ratio: 1:30 with chemically untreated and treated cotton, and polyester/cotton fabric; washing time: 30 minutes. The comparison detergent used was one where instead of the "carboxamide", 1% by weight of sodium sulfate and/or 1% by weight of the adduct of oleyl/cetyl alcohol+5 mols of ethylene oxide (OCA+5EO) was added. From the numerical values of whiteness degrees measured on test fabrics and reported in the Table I, the remarkable improvement in washing power by using a detergent according to the invention is evident.

TABLE I

| Detergent according to Example 1 | Untreated cotton | % Remission Treated cotton | % Remission Polyester/cotton blend |
|---|---|---|---|
| 1 a) with 1% of the δ-hydroxyvaleramide of N-decyl-diaminopropane | 56.2 | 66.5 | 60.7 |
| 1 b) with 1% of the δ-hydroxyvaleramide of N-decyl-diaminopropane | 59.0 | 69.5 | 63.2 |
| 1 c) with 1% of OCA + 5EO | 53.8 | 65.8 | 54.8 |
| 1 d) with 1% of sodium sulfate | 53.2 | 64.1 | 55.1 |

EXAMPLES 2 to 9

Following now are further examples of detergents and cleansers according to the invention. The recipes of the same are given in Table II. The salt-like detergent and/or cleanser constituents listed in above examples—salty tensides, other organic and inorganic salts—are present as sodium salts, if not otherwise indicated. The designations and/or abbreviations in the examples have the following meanings:

"ABS": the salt of an alkylbenzene sulfonic acid with 10 to 15, substantially 11 to 13, carbon atoms in the alkyl chain, which is obtained by condensing straight-chain olefins with benzene and sulfonating the alkylbenzene so produced;

"Olefin sulfonate": a mixture of hydroxyalkanesulfonate, alkene-sulfonate and alkane disulfonate obtained by sulfonating α-olefins having 12 to 18 carbon atoms with $SO_3$ and hydrolizing the sulfonation product with sodium hydroxide solution;

"Fs-estersulfonate": a sulfonate obtained from the methyl ester of hydrogenated palm kernel fatty acid by sulfonation with $SO_3$;

"Alkane sulfonate": a sulfonate obtained by the sulfoxidation of $C_{12-18}$-paraffins;

"Soap": a soap manufactured from a hardened mixture of identical percentages by weight of tallow fatty acids and rape fatty acids (iodine number=1);

"TA+xEO": the addition products of ethylene oxide (EO) added to tallow fatty alcohol (TA) (iodine number=0.5), whereby the numerical values for x characterize the molar amount of ethylene oxide added to 1 mol of alcohol;

"Bleach activator": Tetra-acetylglycoluril;

"Perborate": an industrial product of the approximate composition $NaBO_2.H_2O_2.3H_2O$;

"EDTA": the salt of ethylenediaminetetra-acetic acid;

"NTA": the salt of nitrilo-tri-acetic acid;

"CMC": the salt of carboxymethylcellulose.

Of the Examples in the following Table II, Examples 2, 3 and 9 are those of a powdered detergent with bleach effect, Examples 4 and 5 are powdered pre-wash and main wash detergents without any bleach effect, while Examples 6 to 8 represent a powdered fine detergent, a liquid detergent and a powdered phosphate-free detergent, respectively.

The substituting of the "carboxamides" used in the examples of Table II by other listed compounds of this type, e.g., by γ-hydroxybutyramides of N-decyl-diaminopropane or N-dodecyl-diaminopropane, produces comparable results in the use of these detergents. This is the case also if, for example, in the formulations of Examples 2, 6 and 9 half of the percentage of the 40% by weight of sodium tripolyphosphate is substituted by a crystalline aluminosilicate of the composition 0.96 $Na_2O.1Al_2O_3.1.96SiO_2.4H_2O$, with an average particle diameter of 5.4 $\mu$ and a calcium binding power of 172 mg CaO/gm. In addition to their washing power booster effect, the "carboxamides" used according to the invention also have graying-inhibiting properties effective on polyester and cotton textiles and corresponding mixed fabrics.

The constituents of detergents according to the invention, specifically builders, are so selected that the preparations react neutrally to definitely alkaline, so that the pH-value of a 1% solution of the preparation lies in the 7 to 12 range. Within this range, the fine detergents have a neutral to slightly alkaline reaction (pH-value=7–9.5), while soaking, prewash and boiling detergents have a higher alkaline value (pH-value=9-.5–12, preferably 10–11.5).

TABLE II

| Constituents | Detergent constituents in % for examples | | | | | | | |
|---|---|---|---|---|---|---|---|---|
| | 2 | 3 | 4 | 5 | 6 | 7 | 8 | 9 |
| ABS | 6.0 | — | — | — | 6.5 | — | 6.0 | 6.0 |
| TA + 14 EO | 1.0 | — | 1.0 | 1.5 | — | 4.0 | 1.0 | 2.5 |
| TA + 5 EO | 1.0 | 1.5 | 1.0 | — | — | — | 1.0 | 1.5 |
| Fs-estersulfonate | — | — | 3.0 | 6.0 | — | — | — | — |
| Alkane sulfonate | — | — | — | — | — | 8.0 | — | — |
| Olefin sulfonate | — | 6.0 | 3.0 | — | — | — | — | — |
| Tallow fatty alcohol +3-EO-sulfate | — | — | — | — | 4.0 | — | — | — |
| Soap | 3.5 | 3.5 | 2.5 | 3.0 | 0.5 | — | 3.0 | 3.0 |
| Potassium toluene sulfonate | — | — | — | — | — | 4.0 | — | — |
| δ-hydroxyvaleramide of N-dodecy-diamino-propane | 1.0 | — | — | 1.5 | 1.5 | — | — | 1.5 |
| δ-hydroxyvaleramide of N-decyl-diamino-propane | — | — | 1.0 | — | — | 1.8 | — | — |
| γ-hydroxybutyramide of N-coco-alkyl-diaminopropane | — | 1.0 | — | — | — | — | 1.5 | — |
| $Na_5P_3O_{10}$ | 40.0 | 30.0 | 60.0 | 55.0 | 40.0 | — | — | 40.0 |
| NTA | — | 5.0 | — | 5.0 | — | — | — | — |
| $K_4P_2O_7$ | — | — | — | — | — | 10.0 | — | — |
| EDTA | 0.2 | 0.2 | — | — | — | — | 0.2 | 0.2 |
| Perborate | 15.0 | 15.0 | — | — | — | — | 20.0 | 25.0 |
| Bleach activator | 15.0 | 15.0 | — | — | — | — | — | — |
| Water glass | 3.0 | 3.0 | 4.0 | 5.0 | 3.5 | — | 15.0 3.0 | |
| Sodium carbonate | — | — | 3.0 | 3.0 | — | — | 6.0 | — |
| Mg silicate | 2.0 | 2.0 | — | — | — | — | 2.0 | 2.0 |
| CMC | 1.5 | 1.8 | 1.5 | 1.4 | — | — | 1.2 | 1.5 |
| Isopropylalcohol | — | — | — | — | — | 5.0 | — | — |

Remainder:
Na-sulfate, enzymes, optical brighteners,perfume, water. remainder, Ex. 7, water The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A cold-water-active washing agent composition consisting essentially of (a) from 0.3% to 2.5% by weight of an N-substituted-ω-hydroxyalkane carboxylic acid amide obtained by reacting substantially equimolar amounts of an N-($C_{8-20}$-alkyl)diamino-$C_{2-6}$-alkane with a lactone having the formula

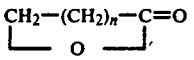

wherein n is an integer from 1 to 4, (b) from 5% to 50% by weight of a tenside mixture of surface-active compounds selected from the group consisting of anionic tensides of the sulfonate type, anionic tensides of the sulfate type, and mixtures thereof, together with further nonionic tensides and optionally soaps, and includes at least 1 part by weight of said anionic tensides of the sulfonate type and/or said anionic tensides of the sulfate type and from 0.2 to 5 parts by weight of said nonionic tensides, in an amount sufficient to give a weight ratio of (a) to (b) of from 1:50 to 1:2, (c) a powdery or liquid carrier material selected from the group consisting of (1) powdery carriers selected from the group consisting of organic builders, inorganic builders and mixtures thereof and (2) liquid carriers selected from the group consisting of water-soluble alkanols, water-soluble alkanediols, water-soluble alkoxyalkanediols, water-soluble alkoxyalkanols, water-soluble alkoxyalkoxyalkanols and water, said component (c) being present in an amount of from 55% to 90% by weight of said washing agent composition, and (d) from 0.5% to 10% by weight of at least one conventional component of the type: foam inhibitors, optical brighteners, soil suspension agents, enzymes, antimicrobials, dyes and perfumes.

2. The cold-water-active washing agent composition of claim 1 wherein the weight ratio of (a) to (b) is from 1:20 to 1:2.

3. The cold-water-active washing agent composition of claim 1 wherein said nonionic tensides are ethoxylated aliphatic $C_{10-20}$ alcohols.

4. The cold-water-active washing agent composition of claim 1 wherein said component (b) is present in an amount of from 5% to 25% by weight.

5. The cold-water-active washing agent composition of claim 1 wherein said component (b) also includes from 0.5% to 5% by weight of an alkali metal soap of substantially $C_{18-22}$ fatty acids.

6. The cold-water-active washing agent composition of claim 1 wherein said N-($C_{8-20}$-alkyl)-diamino-$C_{2-6}$ alkane is a N-($C_{8-20}$-alkyl)-diaminopropane.

7. The cold-water-active washing agent composition of claim 1 wherein said N-($C_{8-20}$-alkyl)-diamino-$C_{2-6}$ alkane is a N-($C_{10-18}$-alkyl)-diaminopropane.

8. A method of washing textiles comprising agitating soiled textiles in an aqueous liquor containing from 1.0 gm/l to 12.0 gm/l of the cold-water-active washing agent composition of claim 1, at a temperature of from 10° C. to 30° C. for 10 to 60 minutes, separating the washed textiles from said aqueous liquor, rinsing said washed textiles with water and recovering washed, rinsed textiles.

9. The method of claim 8 wherein said temperature is from 15° C. to 25° C.

10. The method of claim 8 wherein said aqueous liquor contains from 4.0 gm/l to 10.0 gm/l of the cold-water-active washing agent composition of claim 1.

* * * * *